US008609737B2

(12) United States Patent
Bruijn De et al.

(10) Patent No.: US 8,609,737 B2
(45) Date of Patent: Dec. 17, 2013

(54) PROCESS FOR PREPARING MONODISPERSED EMULSIONS

(75) Inventors: Robin Bruijn De, Eindhoven (NL); John Van Der Schaaf, Zwijndrecht (NL); Narendra Patil, Eindhoven (NL); Jaap Schouten, Heesch (NL)

(73) Assignee: Technische Universiteit Eindhoven, Eindhoven (NL)

( * ) Notice: Subject to any disclaimer, the term of this patent is extended or adjusted under 35 U.S.C. 154(b) by 184 days.

(21) Appl. No.: 13/063,206

(22) PCT Filed: Sep. 7, 2009

(86) PCT No.: PCT/EP2009/061558

§ 371 (c)(1), (2), (4) Date: Mar. 10, 2011

(87) PCT Pub. No.: WO2010/031709

PCT Pub. Date: Mar. 25, 2010

(65) Prior Publication Data

US 2011/0165311 A1 Jul. 7, 2011

(30) Foreign Application Priority Data

Sep. 18, 2008 (EP) ..... 08164611

(51) Int. Cl.
*B01F 3/08* (2006.01)

(52) U.S. Cl.
USPC ..... 516/21; 366/177.1; 366/181.6; 366/348

(58) Field of Classification Search
USPC ..... 516/21; 366/177.1, 181.6, 348
See application file for complete search history.

(56) References Cited

U.S. PATENT DOCUMENTS 4,908,154 A * 3/1990 Cook et al. ..... 516/21
5,674,549 A * 10/1997 Chmiel et al. ..... 426/602

(Continued)

FOREIGN PATENT DOCUMENTS

WO WO 2008/109176 A2 9/2008

OTHER PUBLICATIONS

Qingyi Xu and Mitsutoshi Nakajima, "The generation of highly monodisperse droplets through the breakup of hydrodynamically focused microthread in a microfluidic device," American Institute of Physics, (p. 3726-3728), 2004.

(Continued)

*Primary Examiner* — David Sorkin
(74) *Attorney, Agent, or Firm* — Hammer & Associates, P.C.

(57) ABSTRACT

A process for preparing an emulsion is disclosed comprising: injecting a first liquid as dispersed phase liquid through a central inlet of a microchannel system with a cross junction geometry chip and injecting a second liquid as continuous phase liquid through the outer cross inlet, which continuous phase liquid does not instantly mix with said injected first liquid prior to the cross junction, wherein the flow rate $Q_C$ of the continuous phase in cubic meters per second is given by $$Q_C = f \times \frac{A\gamma}{\mu_d},$$

where A is the exit area of the microchannel in square meters, γ the interfacial tension between the first liquid and the second liquid in Newtons per meter and $\mu_d$ the viscosity of the dispersed phase in Pascal-seconds, characterized in that f is in the range from 0.04 to 0.25.

10 Claims, 6 Drawing Sheets

(56) References Cited

U.S. PATENT DOCUMENTS

| | | | | |
|---|---|---|---|---|
| 8,054,091 | B2 * | 11/2011 | Bhattacharjee et al. | 324/698 |
| 8,302,880 | B2 * | 11/2012 | Clarke | 239/11 |
| 2011/0033413 | A1 * | 2/2011 | Kwetkat et al. | 424/78.03 |

OTHER PUBLICATIONS

Long Wu, Michihisa Tsutahara, Lae Sung Kim, Manyeong Ha, "Three-dimensional lattice Boltzmann simulations of droplet formation in a cross-junction microchannel," International Journal of Multiphase Flow, 34 ed., Elsevier, (p. 852-864), 2008.

T. Nisisako, et al., "Synthesis of Monodisperse Bicolored Janus Particles with Electrical Anisotropy Using a Microfluidic Co-Flow System," Advanced Materials, Wiley-VCH Verlag GmbH & Co., KGaA. (Weinhelm), (Issue. 18), (p. 1152-1156), (Jan. 5, 2006).

Nisisako et al., "Microfluidic large-scale integration on a chip for mass production of monodisperse droplets and particles," The Royal Society of Chemistry, 2008 ed., Lab Chip, (Issue. 8), (p. 287-293).

C. Holtze, et al., "Biocompatible surfactants for water-in-fluorocarbon emulsions," The Royal Society of Chemistry, 2008 ed., Lab Chip, (vol. 8), (p. 1632-1639).

* cited by examiner

PROCESS FOR PREPARING MONODISPERSED EMULSIONS

The present invention relates generally to emulsions and the production of emulsions, and more particularly, to microfluidic systems for forming multiple emulsions, and emulsions produced therefrom.

An emulsion is a fluidic state, which exists when a first fluid is dispersed in a second fluid that is typically immiscible or substantially immiscible with the first fluid. Examples of common emulsions are oil in water and water in oil emulsions. Multiple emulsions are emulsions that are formed with more than two fluids, or two or more fluids arranged in a more complex manner than a typical two-fluid emulsion. Double (or more generally: multiple) emulsions usually consist of a water phase emulsified in an oil phase, which in turn is emulsified in a second water phase or vice versa. For example, a multiple emulsion may be oil-in-water-in-oil (O/WO), or water-in-oil-in-water (W/O/W). Multiple emulsions are of particular interest because of current and potential applications in fields such as pharmaceutical delivery, paints and coatings, food and beverage, and health and beauty aids.

Typically, multiple emulsions consisting of a droplet inside another droplet are made using a two-step emulsification technique, such as by applying shear forces through mixing to reduce the size of droplets formed during the emulsification process as e.g. disclosed by P. Walstra, Formation of Emulsions, in: P. Becher (Ed.), Encyclopedia of Emulsion Technology, vol. 1, Basic Theory, Marcel Dekker Inc., New York, 1983, pp. 57-127.

Other methods such as membrane emulsification techniques, (A. J. Gijsbertsen-Abrahamse et al., Status of cross-flow membrane emulsification and outlook for industrial application", Journal of Membrane Science 230 (2004) 149-159) using, for example, a porous glass membrane, have also been used to produce water-in-oil-in-water emulsions.

Microfluidic techniques have also been used to produce droplets inside of droplets using a procedure including two or more steps. For example, see Anna, et al., "Formation of Dispersions using Flow Focusing in Microchannels," Appl. Phys. Lett., 82:364 (2003), Okushima, et al., "Controlled Production of monodispersed Emulsions by Two-Step Droplet Break-up in Microfluidic Devices," Langmuir 20:9905-9908 (2004) and A. S. Utada, et al, "Monodisperse Double Emulsions Generated from a Microcapillary Device", Science 308, 537 (2005). Lingling Shui, Albert van den Berg and Jan C. T. Eijkel, "Interfacial tension controlled W/O and O/W 2-phase flows in microchannel", Lab Chip 2009, 9, 795-801, DOI: 10.1039/b813724b.

In some of these examples, a T-shaped junction in a microfluidic device is used to first form an aqueous droplet in an oil phase, which is then carried downstream to another T-junction where the oil phase containing internal aqueous droplets is broken down to drops into the outer continuous aqueous phase. This can also be done in cross-junction geometry. In another technique, co-axial jets can be used to produce coated droplets, but these coated droplets must be re-emulsified into the continuous phase in order to form a multiple emulsion.

Multiple emulsions and the products that can be made from them can be used to produce a variety of products useful in the food, coatings, cosmetic, or pharmaceutical industries, for example. Methods for producing multiple emulsions providing consistent droplet sizes, consistent droplet counts, consistent coating thickness, and/or improved control would make commercial implementation of these products more viable.

The present invention generally relates to emulsions, such as primary emulsions, double emulsions or triple emulsions and to methods and apparatuses for making such emulsions. Double or triple emulsions (or higher) are commonly referred to as multiple emulsions.

For example, an emulsion may contain droplets containing smaller droplets therein, where at least some of the smaller droplets contain even smaller droplets therein, etc. Multiple emulsions can be useful for encapsulating species such as pharmaceutical agents, cells, chemicals, or the like. In some cases, one or more of the droplets (e.g., an inner droplet and/or an outer droplet) can change form, for instance, to become solidified to form a microcapsule, a liposome, a polymerosome, or a colloidosome. As described below, multiple emulsions can be formed in one step in certain embodiments, with generally precise repeatability, and can be tailored to include one, two, three, or more inner droplets within a single outer droplet (which droplets may all be nested in some cases). As used herein, the term "fluid" generally means a material in a liquid or gaseous state. Fluids, however, may also contain solids, such as suspended or colloidal particles.

Fields in which multiple emulsions may prove useful include, for example, food, beverage, health and beauty aids, paints and coatings, and drugs and drug delivery. For instance, a precise quantity of a drug, pharmaceutical, or other agent can be encapsulated by a shell designed to rupture under particular physiological conditions. In some instances, cells can be contained within a droplet, and the cells can be stored and/or delivered, e.g., via a polymerosome. Other species that can be stored and/or delivered include, for example, biochemical species such as nucleic acids such as siRNA, RNAi and DNA, proteins, peptides, or enzymes. Additional species that can be incorporated within a multiple emulsion of the invention include, but are not limited to, nanoparticles, quantum dots, fragrances, proteins, indicators, dyes, fluorescent species, chemicals, or the like. A multiple emulsion can also serve as a reaction vessel in certain cases, such as for controlling chemical reactions, or for in vitro transcription and translation, e.g., for directed evolution technology.

Prior art documents, such as the one cited above from Okushima, propose two-step break-up processes for the production of double (W/O/W) emulsions. In a micro-channel structure with two T-junctions, aqueous droplets are formed in an oil phase at the first or upper T-junction and then get encapsulated in the shell of oil phase at the second or lower junction with water as the continuous phase. A hydrophobic junction is mandatory to facilitate the droplet break of inner water phase at the first junction and a hydrophilic junction is mandatory for the droplet break-up of an oil phase at the second junction. Very good control over the external drop size and the internal drop number is achieved.

The two-step break-up process, however, has the drawback that double or multiple emulsions with oils of high viscosity are hard to create in a controlled manner. The consequence is that in a two-step break-up process, it is almost impossible to produce a double emulsion from a primary emulsion with a high internal phase with micron-sized droplets. It is also not favorable to have large droplets from a practical point of view, because an internal phase with a large number of small droplets is more stable than a few large drops.

Christopher et al. (J. Phys. D: Appl. Phys. 40 (2007) R319) study the formation of uniform emulsion droplets in microfluidic (microchannel) devices and discloses that the wettability of the microchannel walls strongly influences droplet formation due to the proximity of the walls and the possibility for either liquid phase to encounter the wall. In order to achieve consistent droplet break-up, it is important that the continuous phase liquid preferentially wets the wall. Therefore Christopher suggests "priming" of the microfluidic device by filling with continuous phase liquid to pre-wet the walls. Droplet formation can significantly be influenced by the system.

Sugiura et al. (J. Colloid Interface Sc. 2004, 270, 221) on the other hand disclose the preparation of W/O/W emulsions by permeation of prehomogenized water-in-oil (W/O) dispersions through arrays of microfabricated nozzles without cross-flow. The coefficient of variation (CV) of such obtained double emulsions ranges from 5.5 to 19%. The oil phase in the W/O/W emulsions according to Sugiura exhibit a diameter between 32.6 and 35.7 μm and are prepared with oil phases of different viscosity (from 1.3 to 69 mPas).

The principle according to Sugiura is, i.e. to form droplets from primary emulsions of high viscosity suffers from the problem that the monodispersity is severely influenced by the system. When such high-viscosity liquids, most of them are oils, come into contact with the wall of the nozzles, the break-up disappears and no droplet is formed.

Xu et al., >> The generation of highly monodispersed droplets through the breakup of hydrodynamically focused microthread in a microfluidic device", Applied Physics Letter Volume 85, Number 17 (2004), 3726-3728 show that using hydrodynamic focusing combined with a suitable microfluidic geometry, forms highly monodispersed droplets with diameters much smaller than the width of the channel junction, without applying additional perturbations. The authors design micromachined channels and adapt the width of the central stream to about 3.5 μm as the critical breakup width.

Wu et al., <<Three-dimensional lattic Boltzmann simulations of droplet formation in a cross-junction microchannel, International Journal of Multiphase Flow 34 (2008) 852-864 numerically study an immiscible liquid-liquid multiphase flow in a cross-junction microchannel by the lattice Boltzmann method. The channels are made of polydimethylsiloxane (PDMS) which has hydrophobic characteristics are recovered through heat treatment at 120° C. for 72 h after plasma bonding with glass plate.

WO 2008/109176 discloses a method that comprises: (a) providing a fluidic droplet containing a species; (b) causing the fluidic droplet to form a gel droplet containing the species; and (c) exposing the species within the gel droplet to a reactant which is reactive with the species. The method is useful for determining species reactive to the gel droplet. It is also useful for producing droplets of consistent size and number and for neutralizing an electric charge present on a fluidic droplet.

The methods of the prior art are strongly dependent from the systems used and consequently the results in terms of size and distribution of the obtained droplets vary with (small) differences of the applied systems. Moreover, due to this dependence, the results are limited by the constructive limits of the applied systems.

It is thus one object of the present invention to provide a process for preparing an emulsion, which process is independent from the system used and which process results in an emulsion that exhibits a monodispersity in droplet diameter with a coefficient of variation of less than 5%.

This object is achieved by a process for preparing an emulsion comprising: injecting a first liquid as dispersed phase liquid through a central inlet microchannel of a microchannel system with a cross junction geometry chip, injecting a second liquid as continuous phase liquid through the outer cross inlet microchannel, which continuous phase liquid does not instantly mix with said injected first liquid prior to the cross junction, and obtaining the emulsion in an exit microchannel, wherein the flow rate $Q_C$ of the continuous phase in cubic meters per second is given by $$Q_C = f \times \frac{A\gamma}{\mu_d},$$

where A is the area of the exit microchannel in square meters, γ the interfacial tension between the first and the second liquid in Newtons per meter and $\mu_d$ the viscosity of the dispersed phase in Pascal-seconds, characterized in that f is in the range from 0.04 to 0.25, preferably from 0.05 to 0.13 and most preferred 0.1, in order to obtain the optimal working line in the operating window.

It should be noted that the term "microchannel" is the commonly used and known by those skilled in the art to describe the channels applied in equipments to obtain emulsions. Nevertheless this term should not be considered limiting the channels and/or the droplets obtained to micrometer sizes. Also much smaller sizes (and in principle greater sizes, too), e.g. nanometer, are encompassed by this term.

Further, the term "liquid" should be understood in its broadest sense, encompassing fluids and solutions etc.

The term "instantly" means that the liquids will not mix noticeable, at least not on molecular basis.

By this invention an operating window is provided which is entirely dependent on the individual fluid properties.

These fluid properties, and subsequently also the operating window, can be influenced by setting the temperature at which the process is operated. For that reason, standard methods for measurement of density, viscosity and interfacial tension are used to find the operating window at a certain temperature. It is preferred to operate at a high temperature, because viscosity is the main limiting property, which will conveniently decrease rapidly with temperature.

It is preferred for the process according to the invention that as the first liquid an oil phase and as the second liquid a water phase is used.

Because water is a preferred liquid as the second liquid—in particular when producing double emulsions—the maximum temperature of the process in this case will be <100° C. at atmospheric pressure (taking into account that pressures are higher in a microchannel system).

It is preferred for process of the invention that the ratio of the dispersed phase flow rate $Q_d$ to the continuous phase flow rate $Q_c$ is $$\leq \frac{0.00272}{Oh^*},$$

wherein Oh* is the Ohnesorge numbers of the system, being:

$$Oh^* = \frac{\mu_c \mu_d}{\sqrt{\rho_c \rho_d \gamma R}},$$

wherein μ is the viscosity in Pascal-seconds, ρ is the density in kilograms per cubic meter, γ is the interfacial tension between the first and the second liquid in Newtons per meter and R is the half-width of the exit microchannel in meters. "c" and "d" denote, respectively, the continuous and the dispersed phase.

To arrive at double emulsions, the first liquid injected is a primary emulsion, obtained by methods known per se, such as applying of high shear forces to and/or sonicating a mixture of two liquids that do not mix in each other (i.e. ultrasound emulsification: Canselier et al., "Ultrasound Emulsification—An Overview", J. of Dispersion Science and Technology 23(1-3), 333-349 (2002)). The obtained primary emulsion droplets can be micron-sized. The resulting double emulsion formed in this process is even more stable in this way.

It is preferred to have a stable emulsion, and it has been studied that emulsions with smaller droplets are more stable than with large ones (Benichou et al., "Double emulsions stabilized by new molecular recognition hybrids of natural polymers." Polym. Adv. Techno. 2002; 13:1019-31 and Preissler et al. "Multiple Emulsionen mit reduziertem Wassergehalt." In: Multiple Emulsionen. Hamburg: Behr's Verlag; 2007. p. 188-206). Also, when considering release characteristics, the release from a large number of small internal droplets will be more gradual than the 'burst' release from a few large droplets. To this end it is preferred, that as the first liquid a primary emulsion with very small droplets is used. The droplet size is preferably less than 1 μm.

When the first step is done by a method, which is already, widely studied and applied, scale-up will be easier and the system will be more robust.

For engineering reasons, the process is preferably carried out on microchannel systems whose inlets and/or the exit channel exhibit a size between 10 and 1000 μm. The profile of the applied microchannels can be round, rectangular or square. Preferred microchannels have a square channel profile.

By choice of the channel sizes the external droplet size of the obtained primary or multiple emulsion can be varied between 5 to 1000 μm, whereby the droplet size is roughly between 0.5. and 1 times the channel size (which is schematically shown by FIG. 8, where R* is the droplet size divided by the channel size).

As a result of the process according to the invention an (external) droplet size which is almost perfectly monodisperse exhibits a coefficient of variation (CV) of less than 5%.

Virtually any liquid can be used for the inventive process. It can, for example, be that the first liquid is either a sunflower oil, or a soybean oil, or an olive oil, or a castor oil or any other organic liquid.

In case a primary emulsion is used as dispersed phase liquid, then preferably those primary emulsions are applied that are obtained from any of the mentioned oils as the continuous phase liquid.

Of course, also solutions of polymers in a suitable solvent can be applied as liquids in the inventive process. Examples are polystyrene, polyethylene polyethyleneglycol in dichloromethane, tetrahydrofuran, or ethylactetate.

A selection of suitable (polymeric) liquids is e.g. disclosed in WO 2008/109176, which document is incorporated herein by reference.

It goes without saying that also those substances can be applied as first (or even second) liquids that are solid at room temperature, provided the process temperature is adjusted such that the substances become liquid, i.e. in their molten form.

By using the inventive method, generation of a double emulsion from a primary emulsion—generated according to several methods known in the prior art—from any liquid, viscous or even solid at room temperature a high monodispersity with a CV of less than 5% is possible with no influence from the system without the need to change the hydrophobic or hydrophilic properties of the applied channel.

Moreover, use of surfactants is not needed. These can be added later for extra stability and/or to influence the interfacial tension γ for a better operating window.

The invention is further illustrated by the following examples, but do not exemplify the full scope of the invention.

SHORT DESCRIPTION OF THE FIGURES

DESCRIPTION OF THE MEASUREMENT METHODS

The viscosity was measured using a Brook field viscometer DV-I Prime. The standard method of the supplier was used.

Interfacial tension was measured according to ASTM D971-99a (2004) The density was determined according to ASTM D1298-99 (2005)

The coefficient of variation (CV) is a normalized measure of dispersion of a probability distribution. It is defined as the ratio of the standard deviation a to the mean M:

$$CV=\sigma/M.$$

In the course of this description the CV value is often reported as a percentage (%) by multiplying the above calculation by 100.

Figure 1:
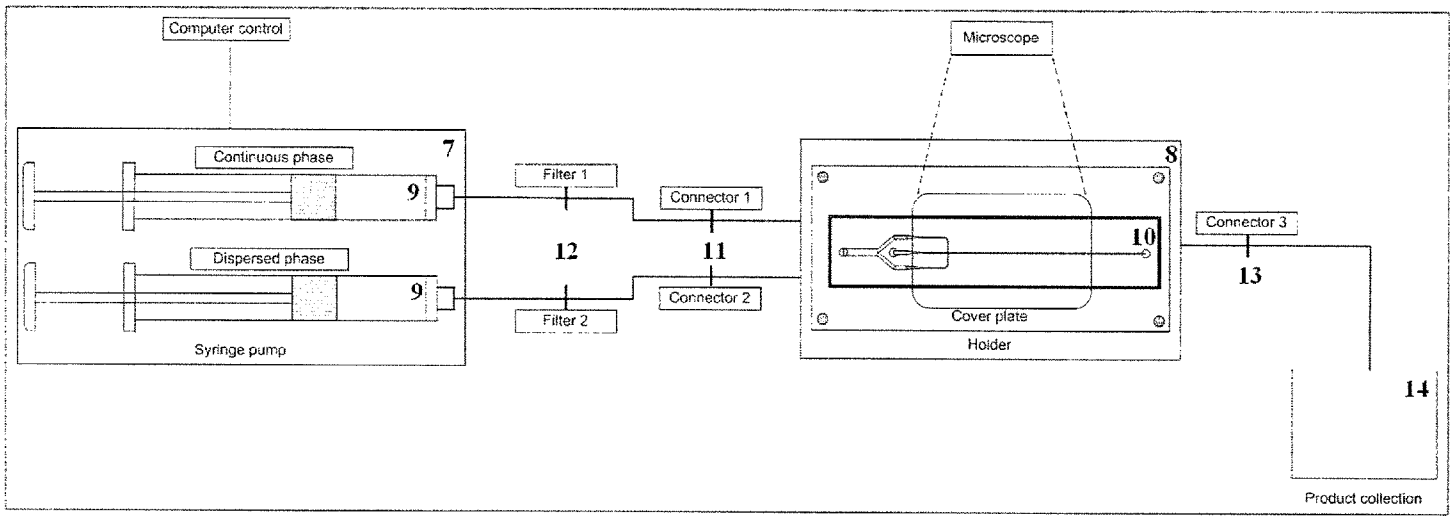
FIG. 1 shows schematically a setup of a suitable system for carrying out the process according to the invention.

Turning now to FIG. 1 the setup of a suitable system is shown, essentially consisting of a syringe pump module 7 and a chip holder module 8, which contains the microchannel system. Both the liquids for the continuous phase and the dispersed phase, when pumped by the syringe pump, flow from the respective syringes 9 into the cross-junction geometry chip 10. The syringe pump module 7 and the chip holder module 8 are linked via connectors 11 and filters 12. Once out of the cross-junction geometry chip 10 the obtained emulsion flows via connector 13 into the collection vessel 14.

Figure 2:
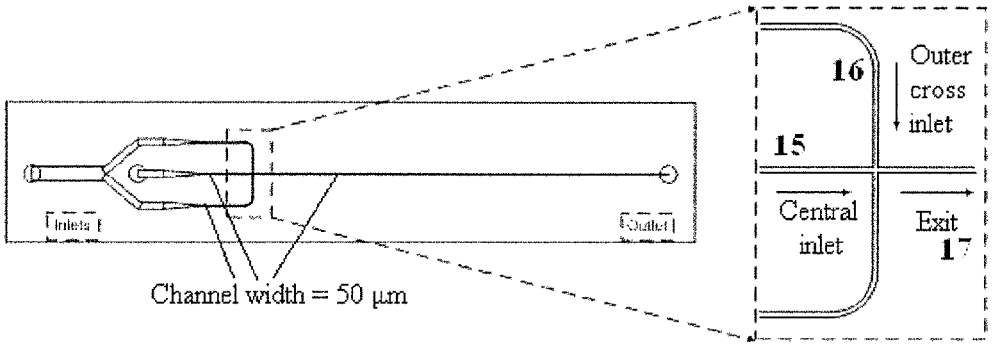
FIG. 2 shows schematically the detail enlargement of the microchannel system with cross-junction geometry chip displayed within the bold rectangle of FIG. 1. The sizes of the channels are 50 μm (wide) by 50 μm (deep).

Turning now to FIG. 2 the microchannel system with the cross-junction geometry chip 10 of FIG. 1 is shown in enlarged view, which chip is essentially consisting of a central inlet microchannel 15 for the dispersed phase liquid and an outer cross inlet microchannel 16 for the continuous phase liquid as well as an exit microchannel 17 for the emulsion obtained.

Figure 3:
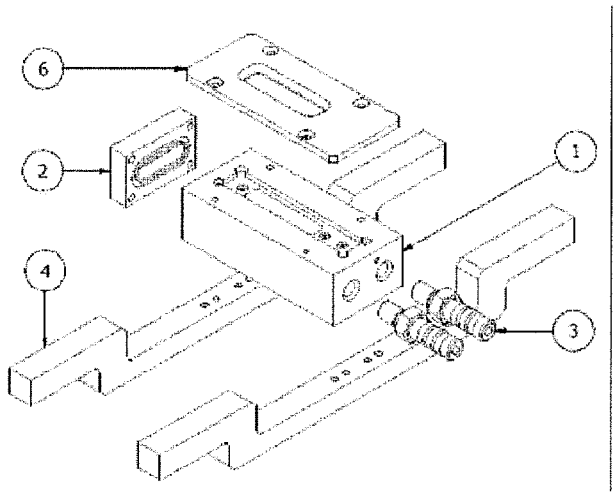
FIG. 3 shows schematically a chip holder in exploded drawing, denoted as "Holder" in FIG. 1.

Turning now to FIG. 3, the chip holder within the chip holder module 8 is depicted that facilitates the flow of liquids pumped through individual syringes 9 by the syringe pump into the cross-junction geometry chip 10.

The chip holder has brass block with internal cavity 1 for a heating liquid, where a liquid for heating can pass through. It keeps the cross-junction geometry chip 10 at a certain temperature set by an external thermostat providing silicone oil for heating. Further, a brass cap 2 for flowing the heating liquid back to the front of the chips, the fittings 3 for tubing from the thermostat, carrying the heating liquid, the metal holders 4, and the brass plate 6 to hold the chip are shown. Plastic lining (not shown) was used to protect the glass chip from the metal.

Figure 4:
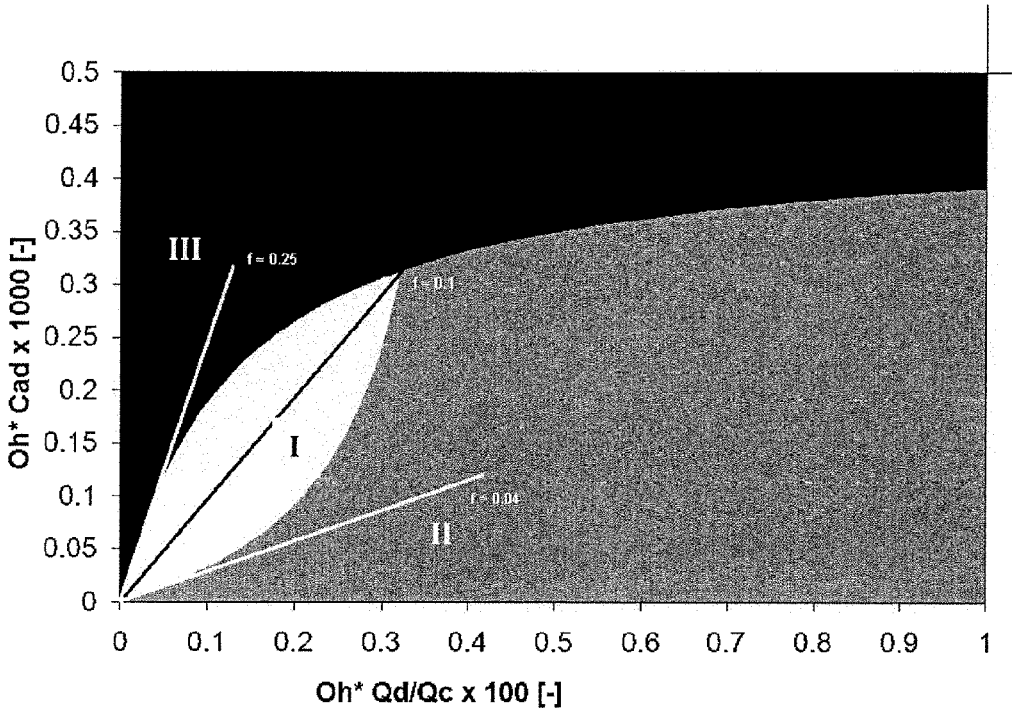
FIG. 4 shows a graph that displays an area designated 'I', which can be attributed to the process window of the present invention. The line from the origin through area 'I' is the optimal working line.

The operating window, in the area designated 'I', is schematically shown by the graph in FIG. 4. In order to enable the skilled person to arrive at the operating windows the following guidelines are given. It goes without saying that the numbers and formulae may show some deviations in experimental practice, which are still within the scope of the inventions. The skilled artisan is able to carry out the invention on the basis of the following figures without undue burden.

This window is characterized as an area between the curves:

$$Oh^* Ca = A_1\left(\frac{B_1}{Oh^*\frac{Q_d}{Q_c}} + 1\right)^{-1}$$

$$Oh^* Ca = A_2\left(\frac{B_2}{Oh^*\frac{Q_d}{Q_c}} - 1\right)^{-1}$$

where Oh* has been defined above and Ca is the capillary number, defined as:

$$Ca = \frac{\mu_d Q_d}{A\gamma}$$

with constants defined above and the values:
$A_1$: $2.69\cdot10^{-4}$ $A_2$: $6.41\cdot10^{-5}$
$B_1$: $1.033\cdot10^{-3}$ $B_2$: $3.616\cdot10^{-3}$
The most preferred working line in this operating window 'I' is defined as $$Q_C = f \times \frac{A\gamma}{\mu_d},$$

where f is 0.1. (f=0.04 and f=0.25 refer to the lines 'II' and 'III' in FIG. 4, respectively)

Example 1

Figure 5:
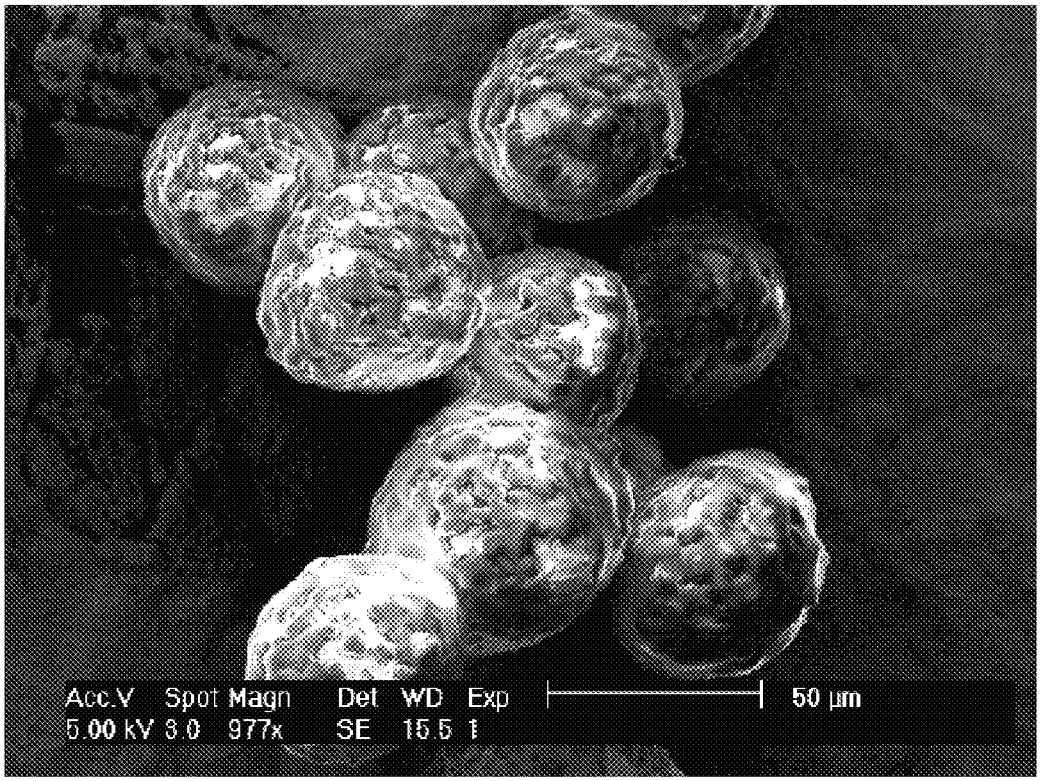
FIG. 5 shows an image of an oil-in-water (O/W) emulsion taken by a Scanning Electron Microscope (SEM).

Cacao: The cacao butter was melted and emulsified with only water without addition of any surfactant at 50° C., having a viscosity of about 33 mPa·s (47 mPa·s at 40° C.). The operating $Q_c$ was calculated to be 0.4 ml/hr and the maximum $Q_d/Q_c$ to be 0.05. Flow rates on the chip (with 50 by 50 μm channel size) were chosen to be 0.02 ml/hr for the dispersed phase, 0.5 ml/hr for the water phase (which is within region "I" in FIG. 4). The image of the resulting drops taken by a Scanning Electron Microscope (SEM) is shown in FIG. 5. Average drop size was 44 μm with a CV of 3%.

Example 2

W/O/W: Primary emulsion prepared by ultrasound emulsification of triolein with 10% v/v distilled water. Temperature was around 60° C., leading to a viscosity of about 20 mPa·s (84 mPa·s at room temperature). As surfactant, 3 weight % of Tween 20 was used in the water phase. The operating $Q_c$ was calculated to be 0.7 ml/hr and the maximum $Q_d/Q_c$ to be 0.1. Flow rates on the chip (with 50 by 50 μm channel size) were chosen to be 0.02 ml/hr for the primary emulsion, 1 ml/hr for the (distilled) water phase (which is within region "I" in FIG. 4).

Figure 6:
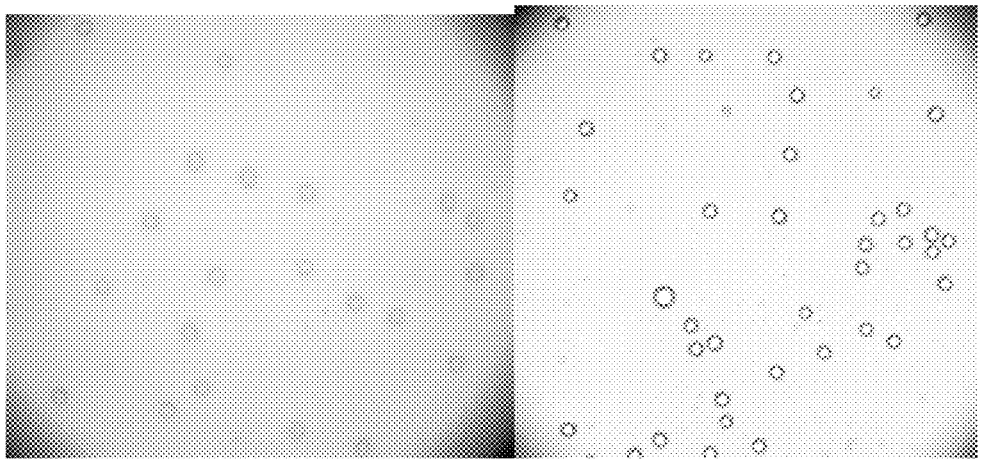
FIG. 6 shows two images taken by an optical microscope through a 100× lens of a water-in-oil-in-water (W/OW) emulsion, whereas the left one is taken immediately after production and the right one after a week.

FIG. 6 shows the images taken by an optical microscope through a 100× lens. The left image is taken immediately after production, the right image after a week, showing the stability of the obtained double-emulsion. Average drop size was 22 μm with a CV of 4%.

Example 3

Figure 7:
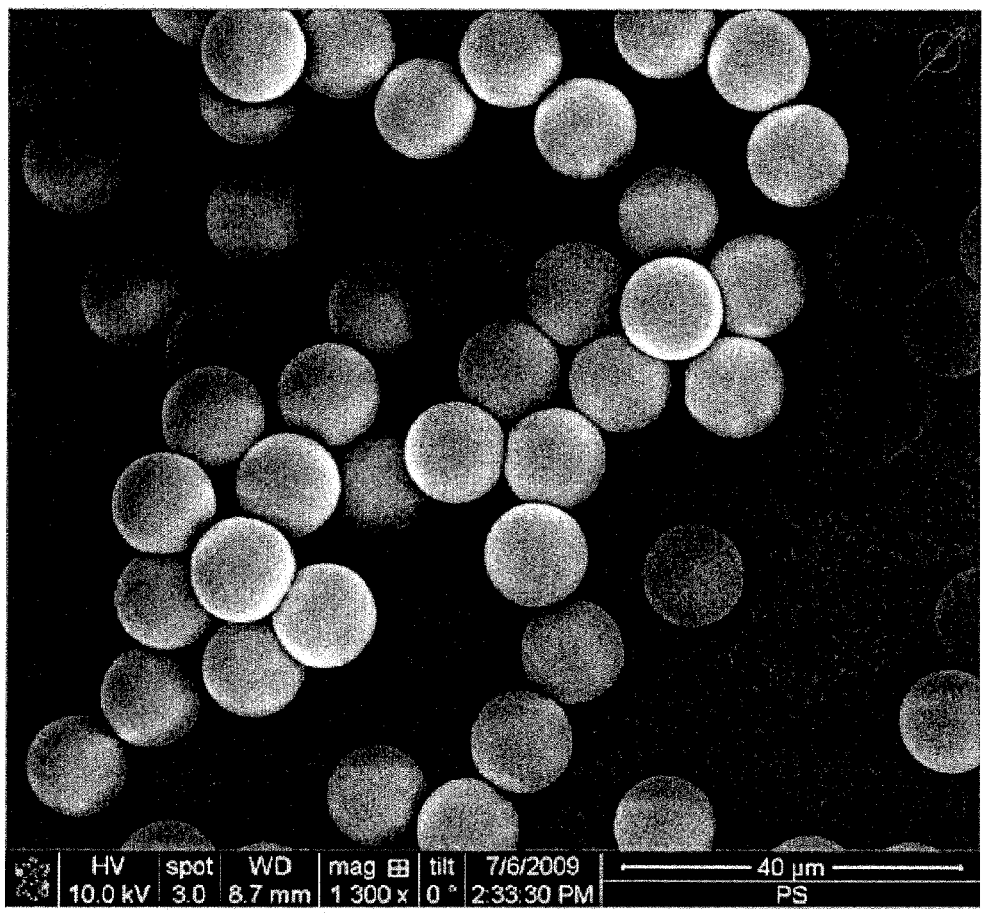
FIG. 7 shows an image of microspheres taken by a Scanning Electron Microscope (SEM).
Figure 8:
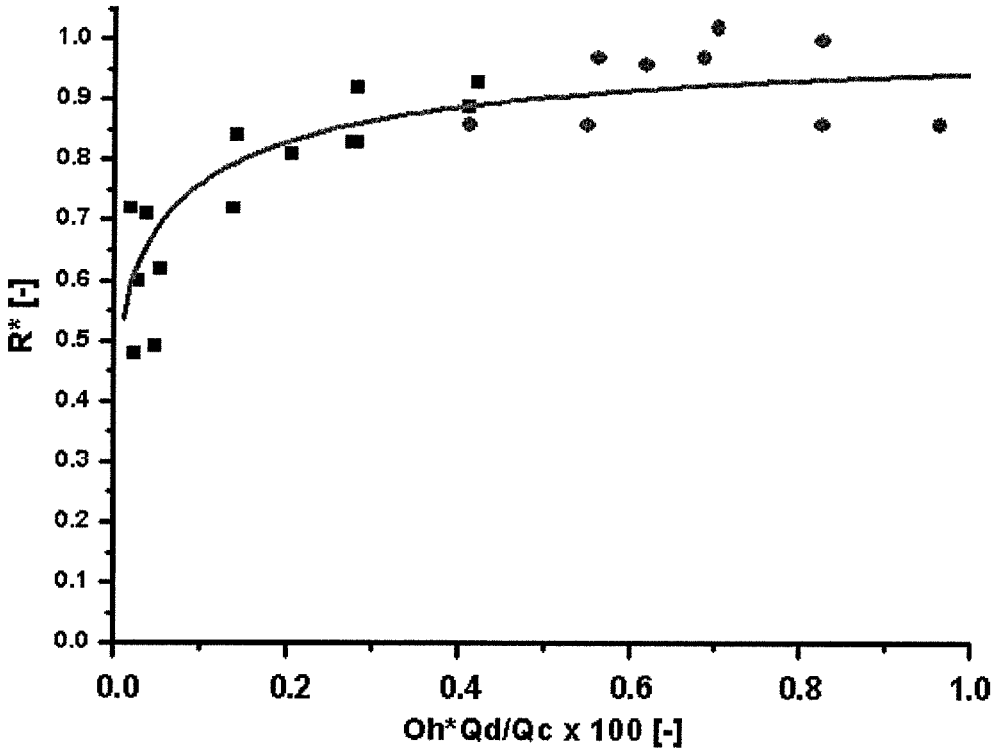
FIG. 8 shows a graph related to droplet size/channel size ratio. The Y-axis displays this ratio and the X-axis is the same as in FIG. 4.

Microspheres: Polystyrene (PS) was dissolved in dichloromethane (DCM) in an amount of 2 wt. % without addition of any surfactant at 25° C. Viscosity was about 2.4 mPa·s. The operating Qc was calculated to be 5 ml/hr and the maximum Qd/Qc to be 1. Flow rates were kept lower to prevent acute blockage by polymer deposition in the chip (with 50 by 50 μm channel size), so they were chosen to be 0.08 ml/hr for the dispersed phase and 2 ml/hr for the water phase. This resulted in monodispersed droplets of dissolved PS, which was subsequently hardened through solvent extraction of the DCM by the surrounding water phase. The image of the resulting microspheres taken by a Scanning Electron Microscope (SEM) is shown in FIG. 7. Average sphere size was 12.1 μm with a CV of 1.3%.

The invention claimed is:

1. A process for preparing an emulsion comprising the steps of:

injecting a first liquid as a dispersed phase liquid through a central inlet microchannel of a microchannel system with a cross junction geometry chip, injecting a second liquid as a continuous phase liquid through an outer cross inlet microchannel, which continuous phase liquid does not instantly mix with said injected first liquid prior to the cross junction, and obtaining the emulsion in an exit microchannel, wherein the flow rate $Q_C$ of the continuous phase in cubic meters per second is given by $$Q_C = f \times \frac{A\gamma}{\mu_d},$$

where A is the area of the exit microchannel in square meters, γ the interfacial tension between the first liquid and the second liquid in Newtons per meter and $\mu_d$ the viscosity of the dispersed phase in Pascal-seconds, characterized in that f is in the range from 0.04 to 0.25, and in that the ratio of the dispersed phase flow rate $Q_d$ to the continuous phase flow rate $Q_c$ is $$\leq \frac{0.00272}{Oh_c * Oh_d}$$

wherein $Oh_c$ and $Oh_d$ are respectively the Ohnesorge numbers of the continuous phase and of the dispersed phase, being $$Oh_i = \frac{\mu_i}{\sqrt{\rho_i \gamma R}}$$

wherein μ is the viscosity in Pascal-seconds, ρ is the density in kilograms per cubic meter, γ is the interfacial tension between the first liquid and the second liquid in Newtons per meter and R is the half-width of the exit microchannel in meters.

2. The process of claim 1, characterized in that as the first liquid an oil phase is used and as the second liquid a water phase is used.

3. The process of claim 1, characterized in that a mixture of two liquids that do not mix in each other is used as the first liquid in a primary emulsion obtained by applying of high shear forces to and/or sonicating the mixture of two liquids that do not mix in each other.

4. The process of claim 3, characterized in that a primary emulsion with very small droplets is used as the first liquid.

5. The process of claim 3, characterized in that the droplet size of the primary emulsion is less than 1 μm.

6. The process of claim 1, characterized in that the inlet microchannel for the dispersed phase liquid and the inlet microchannel for the continuous phase liquid and/or the exit channel of the microchannel for an obtained emulsion each exhibits a size between 10 and 1000 μm.

7. The process of claim 1, characterized in that the external droplet size of an obtained primary or multiple emulsion is varied between 5 to 1000 μby applying the microchannel sizes of between 10 and 1000 μm.

8. The process of claim 7, characterized in that the external droplet size of the obtained primary or multiple emulsion exhibits a coefficient of variation (CV) of less than 5%.

9. The process of claim 1, characterized in that the first liquid is either a sunflower oil, or a soybean oil, or an olive oil, or a castor oil, or any other organic liquid or a primary emulsion obtained from using any of these oils as the continuous phase liquid.

10. The process of claim 1, characterized in that the first liquid is a polymer solution or an emulsion of a polymer, wherein the polymer is polystyrene, polyethylene, polyethyleneglycol, in a suitable solvent, wherein the solvent is dichloromethane, tetrahydrofuran, or ethylactetate.

* * * * *